United States Patent [19]

Harvey et al.

[11] 4,034,649

[45] July 12, 1977

[54] AUTOMATIC SELF-LEVELING FORKS

[75] Inventors: Samuel E. Harvey; Harvey W. Liberman, both of Knoxville; Steven C. Voorhees, Oak Ridge, all of Tenn.

[73] Assignee: Carrier Corporation, Syracuse, N.Y.

[21] Appl. No.: 402,714

[22] Filed: Oct. 2, 1973

Related U.S. Application Data

[62] Division of Ser. No. 846,569, July 31, 1969, Pat. No. 3,827,587.

[51] Int. Cl.[2] ..... F15B 11/20; F15B 11/22

[52] U.S. Cl. ..... 91/412; 60/484

[58] Field of Search ..... 91/411, 412; 60/484; 137/101

[56] References Cited

U.S. PATENT DOCUMENTS

| | | | |
|---|---|---|---|
| 3,039,266 | 6/1962 | Schenkelberger | 137/101 X |
| 3,120,314 | 2/1964 | King | 214/771 |
| 3,140,787 | 7/1964 | Clar | 214/302 |
| 3,179,120 | 4/1965 | Erickson et al. | 214/771 X |
| 3,494,259 | 2/1970 | Sumida | 91/6 X |
| 3,495,610 | 2/1970 | Van Aken | 91/412 X |
| 3,679,179 | 7/1972 | Praddaude | 91/412 X |

*Primary Examiner*—Carlton R. Croyle
*Assistant Examiner*—Edward Look
*Attorney, Agent, or Firm*—Burns, Doane, Swecker & Mathis

[57] ABSTRACT

Apparatus for automatically leveling the forks of vertically moveable hoist arms. In a typical embodiment, the arms are used on refuse collection vehicles for lifting and dumping detachable containers into the body of the vehicle. The arms are pivotally mounted at one end on the vehicle and the opposite ends of the arms has fork devices for engaging brackets on opposite end walls of the detachable containers. Swinging movement of the arms and of the forks is accomplished by means of hydraulic cylinders or rams. A hydraulic pump supplies fluid under pressure to the arm cylinders for raising the arms. A portion of the fluid is conducted to the fork cylinder by means of a gear or vane type flow divider, so that the rate of extension of the piston in each fork cylinder is at a predetermined ration of the displacement of the arm piston. This causes the forks to swing downwardly at a predetermined rate while the arms are being raised toward a dumping position, thereby maintaining the container approximately horizontal until it is in position to be inverted for dumping.

4 Claims, 8 Drawing Figures

AUTOMATIC SELF-LEVELING FORKS

CROSS REFERENCE TO RELATED APPLICATION

This is a division of our co-pending patent application Ser. No. 846,569, filed July 31, 1969, entitled "Automatic Self-Leveling Forks" now U.S. Pat. No. 3,827,587.

BACKGROUND OF THE INVENTION

This invention relates to materials handling equipment, and more particularly to apparatus for lifting and dumping detachable containers.

It has become a common practice to provide a number of detachable containers at various locations for receiving refuse. These containers are emptied periodically into the body of a truck, in which the refuse is compacted and then transported to a disposal area. The collection vehicle typically has an enclosed body with an opening at the top for receiving the material from the container. A pair of hoist arms are mounted for vertical swinging movement about a horizontal axis located behind the cab of the vehicle on the truck frame. The hoist arms each have a fork which is adapted to fit into sleeves on opposite sides of the container. The container has hinged cover doors at the top and when the hoist arms are raised, the container is picked up and transported over the cab and then inverted, causing the contents to fall from the container through the opening in the top of the body. The container is then returned to the ground by swinging the arms downwardly.

Usually, the forks are pivotally mounted on the hoist arms and the angular displacement of the forks relative to the hoist arms is controlled by hydraulic cylinders connected at one end with the hoist arms and at the opposite end with the forks. The fork cylinders are used primarily to tilt the container relative to the hoist arms as it is being raised to a dumping position. Examples of container dumping vehicles of this type are described in U.S. Pat. Nos. 2,951,600 and 3,078,000.

Conventional container hoist apparatus is controlled by manual hydraulic valves. One valve lever controls the raising and lowering of the hoist arms, another valve lever controls the angle of tilt between the forks and the hoist arms and a third valve lever controls movement of a packer head in the body for compacting the refuse after it has been dumped out of the containers. When the operator of the vehicle dumps a container into the body of the truck, it is necessary first to swing the arms downwardly until the forks are aligned with the sleeves on the container which is located directly in front of the vehicle. The vehicle is then moved forward to allow the forks to enter the sleeves in the container. At this time, the forks are approximately horizontal. The hoist arms are then raised toward the opening in the top of the body. As the arms swing vertically, the forks must be lowered gradually in order to maintain the container approximately horizontal, and thereby to avoid spilling the contents of the container. Typically this is done by opening the manual fork valve and using the weight of the container to swing the forks downwardly as the hoist arms are being raised. This requires careful coordination by the operator between movement of the arm valve lever and the fork valve lever. An inexperienced operator often has difficulty in coordinating these movements and will usually resort to a step-wise operation in which the arms are raised a few degrees and stopped, and then the forks are lowered a few degrees to compensate for the movement of the arms. These steps are then repeated until the container is over the hopper and ready for dumping. The lack of coordination between the movement of the forks and the arms does not allow the lifting portion of the operation to be performed at its optimum efficiency. Also, there is a danger that the fork valve lever will be moved in the wrong direction inadvertently, thereby spilling the contents of the container. Another problem with individual manual controls for the hoist arms and the forks is that additional time is required to train new operators to coordinate movement of these controls.

Various attempts have been made to provide automatic leveling of the forks while raising the hoist arms. It has been proposed, for example, to use limit switches and various cam devices for operating the fork cylinders in response to predetermined positions of the hoist arms. Another suggestion has been the use of a parallelogram linkage between the hoist arms and the forks. Neither of these proposals is satisfactory. The use of limit switches or other mechanical devices on the body of the truck requires accurately positioning the devices on the vehicle, but the vehicle is usually subjected to severe shock, leading to inaccuracies in the operation. Also, these systems require extensive wiring and are difficult to install on existing equipment. The parallelogram type loader has several moveable interconnecting links and the joints connecting these links are subject to wear and are a source of possible failure.

SUMMARY OF THE INVENTION

In view of the deficiencies noted above, it is an object of this invention to provide an improved container hoist.

It is a further object of this invention to provide a vehicle mounted hoist in which the fork arms are automatically maintained approximately horizontal during raising of the hoist arms.

Another object of this invention is to provide a container hoist which automatically maintains the forks approximately horizontal while lifting a container, but is capable of manual swinging movement of the forks relative to the hoist arm at any position of the hoist arm.

A still further object of this invention is to provide an improved container hoist in which the forks are automatically leveled during raising of the arms and in which the hydraulic system minimizes power and fluid requirements.

These objects are accomplished in accordance with a preferred embodiment of the invention by proportioning the flow of fluid to the fork cylinders and the arm cylinders at a fixed ratio to cause the forks to swing downwardly as the arms swing upwardly. The proportion of hydraulic fluid discharging from the fork cylinders is selected to maintain the forks approximately horizontal as the hoist arms are being raised. The rate of flow of fluid to the arm cylinders and the fork cylinders is controlled by means of a gear or vane type flow divider and fluid is trapped on opposite sides of the arm and fork pistons so that the arms and the forks are maintained at any position when the flow of fluid in the system is stopped. Various alternate preferred embodiments include two nonregenrative systems.

DESCRIPTION OF THE DRAWINGS

These preferred embodiments are illustrated in the accompanying drawings in which.

DESCRIPTION OF PREFERRED EMBODIMENTS

Figures 1, 2:
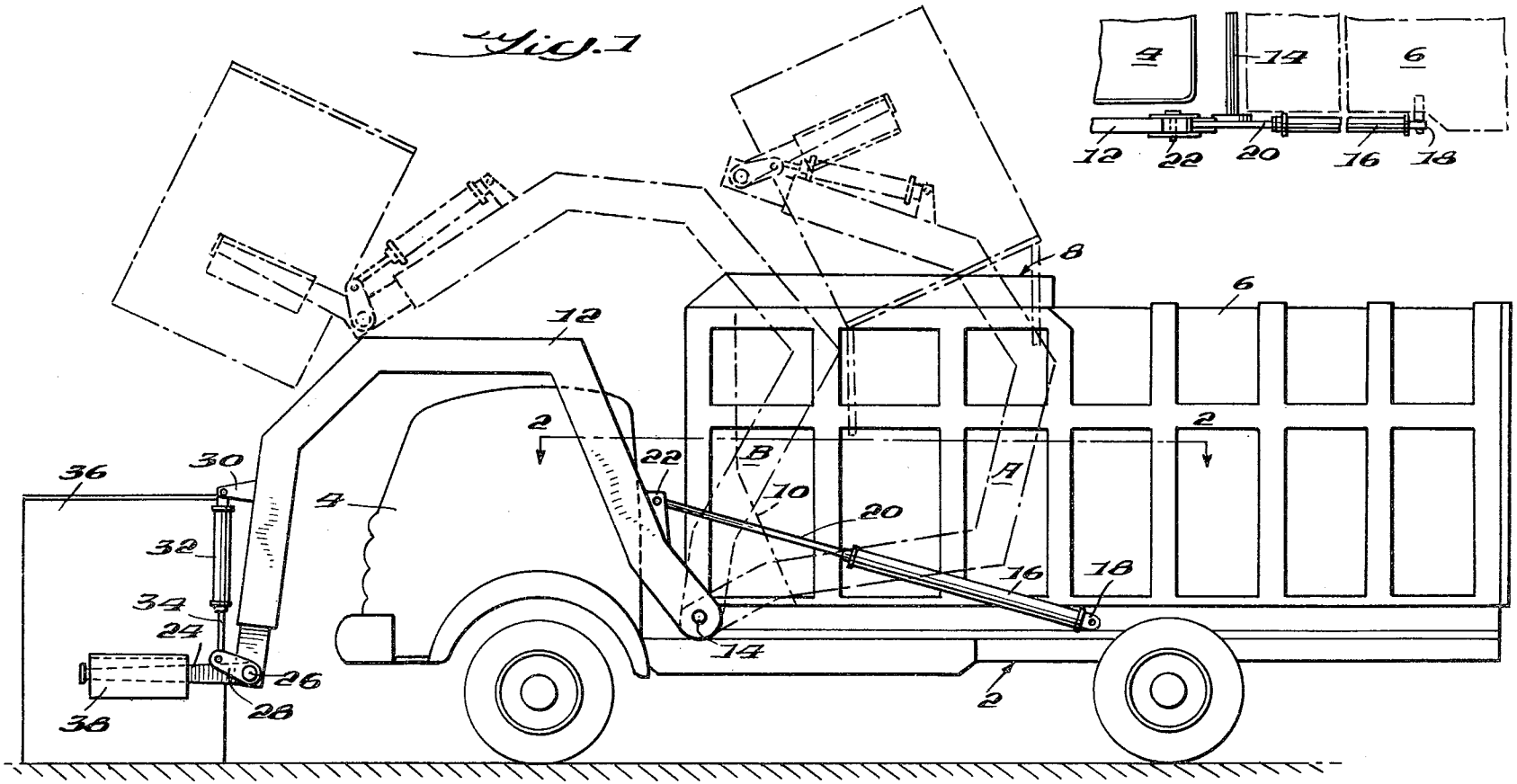
FIG. 1 is a side elevational view of the fork and arm assembly mounted on a refuse collection vehicle.
FIG. 2 is a cross sectional view of a vehicle; along the line 2—2 in FIG. 1.

Referring to FIG. 1, a truck chassis 2 includes a cab 4 which houses the operator and the controls for the vehicle. A refuse body 6 is supported on the chassis 2 and has an opening 8 at the top through which refuse may be dumped into the interior of the body 6. Typically, the body 6 includes a movable packer head 10 for compacting the refuse toward the rear of the body.

The vehicle also includes a pair of arms 12 which are positioned on opposite sides of the cab 4, with one end of each arm being secured on a torque tube or shaft 14 which extends transversely of the chassis 2, as shown in FIG. 2. The arms are fixed on the tube 14, so that they cannot swing relative to each other, but are free to swing vertically relative to the truck chassis. A hydraulic ram 16 is positioned at each side of the body 6 for swinging the arms 12 vertically. The head end of each arm cylinder 16 is pivotally connected to the body 6 by a bracket 18 on the cylinder and a pin on the body. The piston rod 20 of each hydraulic cylinder 16 is pivotally connected with the arm 12 by means of a pin 22 spaced from the torque tube 14. The arms 12 are spaced apart from each other a distance greater than the width of the cab 4 and of the body 6, so that the arms are free to swing from the position shown in full lines in FIG. 1 to the fully raised position indicated at A.

Each arm 12 has a fork 24 mounted on a shaft 26 for swinging movement relative to the arm 12. A lever 28 is also secured on the shaft 26, so that the lever swings with the fork 24. A bracket 30 on the arm 12 pivotally supports the head end of a hydraulic cylinder 32. The piston rod 34 of the cylinder 32 is connected with the lever 28 by a pin 36. When the piston rod 34 is drawn inwardly of the cylinder 32, the lever 28 swings upwardly, as viewed in FIG. 1, causing the fork 24 also to swing upwardly.

A detachable container 36 is positioned in front of the truck chassis 2. The container 36 has sides which are spaced apart a distance slightly less than the distance between the arms 12 and the opposite sides are provided with sleeves 38 for receiving the forks 24 of each arm 12. The general arrangement of the arms 12, the forks 24, and the container 36 is illustrated and described in U.S. Pat. Nos. 2,951,600 and 3,078,000.

Figure 4:
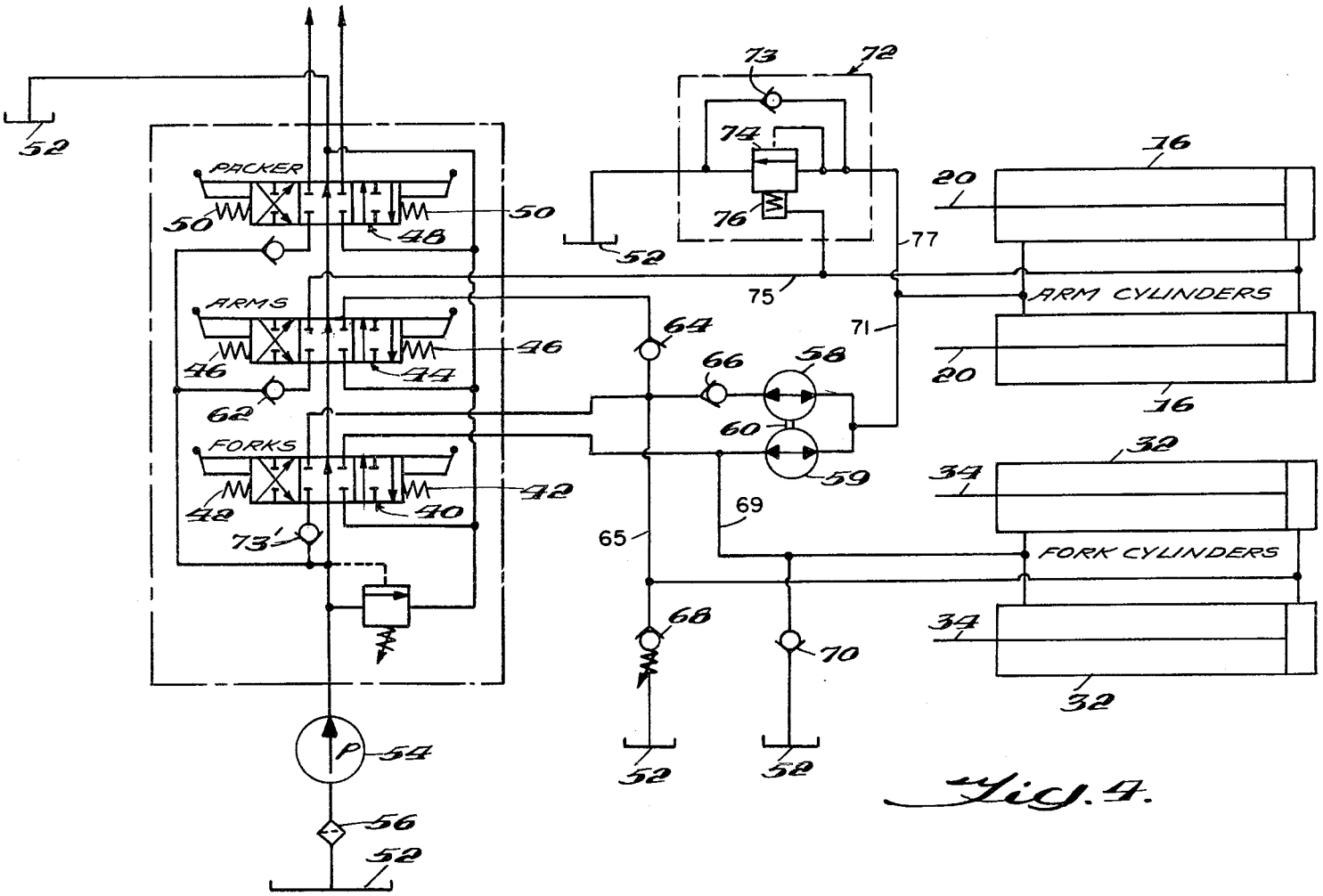
FIG. 4 is a schematic diagram of the first embodiment of the hydraulic circuit for operating the arms and forks.

The controls for operating each lifting arm cylinder 16 and ech fork cylinder 32, as well as the packer 10 are shown schematically in FIG. 4. A control valve 40 for the forks 24 includes a three position valve spool which is biased toward the center position by opposed springs 42 and is movable by means of a manual lever. A second manual spool valve 44 is provided for controlling the lifting arms 12. A three position spool valve 48 is also provided for the packer 10. Each of the valves 40, 44 and 48 have three positions and are biased toward a neutral position by opposed springs 42, 46 and 50, respectively. Hydraulic fluid is supplied under pressure from a reservoir 52 by a pump 54 which draws fluid through a filter 56.

The arm cylinders 16 and the fork cylinders 32 are indicated schematically in FIG. 4. The piston rods 20 are connected with the pistons in the cylinders 16 and the piston rods 34 are shown schematically as being connected with the pistons in the fork cylinders 32. When the valve spools are in the position shown in FIG. 4, fluid passes through the center position of each valve and returns to the reservoir 52. Fluid is trapped in each arm cylinder 16 and in each fork cylinder 32, so that the arms and forks are held stationary.

The hydraulic circuit of FIG. 4 also includes a pair of positive displacement reversible rotary flow regulating devices 58 and 59. Preferably, these devices preferably include a housing and gear type or vane type rotors which limits the volume rate of flow of fluid passing through the housing for a particular speed of rotation. The devices 58 and 59 can operate as motors or pumps depending on whether energy is being supplied or removed from the motor shaft. The rotor shaft of the device 58 is joined with the rotor of the device 59 by a shaft 60, as indicated schematically in FIG. 4. This causes the rotors to turn together, thereby transmitting torque from one device to the other. These devices 58 and 59 are connected together so that one of the devices acts as a motor driven by the flow of fluid through the device and torque is transmitted from the motor to the other device for pumping fluid from a zone at lower pressure to a zone at higher pressure. Also, since the devices have a constant displacement, the ratio of flow rates through the devices remains constant, regardless of the pressure differential across the respective devices.

Figure 3:
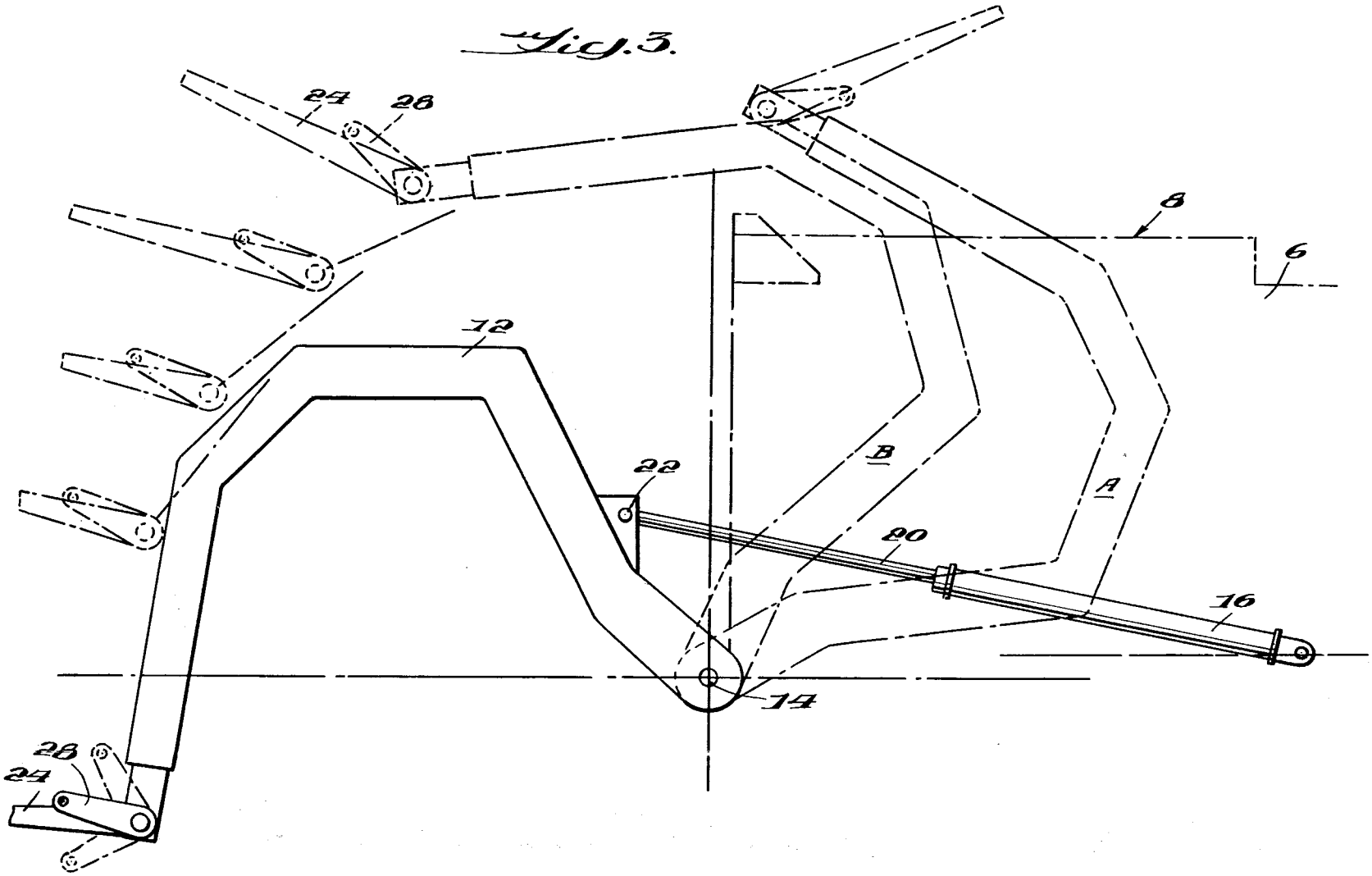
FIG. 3 is a side elevational view, partially schematic, showing the movement of the arms and forks.

Referring to FIG. 3, when the lifting arms 12 are being raised by operation of the arm cylinders 16, it is desirable for the forks 24 to remain nearly horizontal to avoid spilling the contents of the container. Since the arms 12 swing rearwardly, it is necessary to extend the piston in the fork cylinder 32 at a rate that corresponds to the displacement of the piston in the cylinder 16. When the spool of the arm valve 44 is manually displaced toward the right as viewed in FIG. 4 fluid is conducted from the pump 54 under pressure through check valves 62, 64 and 66 to the reversible rotary device 58. Fluid under pressure is also conducted through the circuit 65 to the head end of the fork cylinders 32, urging the piston rods 34 outwardly. A spring biased relief valve 68 is set at a higher pressure than that delivered by the pump 54 and opens only in the event of overload to conduct fluid back to the tank or reservoir 52. Since the rod end of the fork cylinders 32 is filled with fluid, movement of the pistons toward the left as viewed in FIG. 4 forces fluid from the rod end of the cylinders 32 through the conduit 69 to the device 59. Since the movement of the piston in the fork cylinders 32 is limited by the rate of discharge of fluid from the rod end of the fork cylinder, the downward swinging movement of the forks 24 is positively controlled.

The volume rate of flow through the device 58 is at a predetermined ratio to the flow through the device 59 because the rotors of the devices are connected together. Due to the area differential on opposite sides of the fork piston, fluid is conducted to the device 59 at a higher pressure than the pressure supplied by the pump 54. Consequently, the device 59 acts as a motor transmitting torque through the shaft 60 to the device 58 which acts as a pump. The discharge pressure downstream from the pump 58 and motor 59 is between the pressure supplied by the pump 54 and pressure at the rod end of the fork cylinders 32. The combined flow from the pump 58 and motor 59 is conducted to the rod end of the arm cylinders 16 through the conduit 71 for displacing the pistons toward the right as viewed in FIG. 4. Fluid is discharged from the head end of the arm cylinders through the conduit 75 and through the valve 44 to the tank 52.

When the fork piston has reached the outermost extent of travel, flow from the rod end of the cylinders 32 stops thereby cutting off the supply of fluid energy for driving the device 59. In this condition, the device 59 acts as a pump driven by the device 58 and the discharge pressure of the devices 58 and 59 is less than the pressure supplied by the pump 54. The check valve 70 permits fluid to be drawn from the reservoir 52 into the conduit 65 by the rotary device 59 to avoid cavitation. The supply of fluid to the rod end of the cylinders 16 continues, without interruption, and the arms continue to move upwardly, although at a faster rate.

In order to lower the lift arms 12 it is necessary to reverse the position of the spool in the valve 44, so that the right-hand position is aligned with the conduit from the pump 54 and to the reservoir 52. Fluid under pressure is then conducted from the pump 54 through the conduit 75 directly to the head end of the arm cylinders 16. Fluid is discharged from the rod end of the cylinders 16 and conducted through conduit 77 and through an overcenter valve 72 to the reservoir 52. The overcenter valve is used to control the speed of the piston when the load tends to move the piston faster than fluid is being supplied by the pump. Overcenter valves are well known in the art and are available commercially from Fluid Controls, Inc., Mentor, Ohio.

The valve 72 includes a relief valve 74 which is set to open at a pressure greater than the pressure due to the fluid acting on the head end of the arm pistons and a pilot valve 76 urges the relief valve 74 to open as long as fluid is being supplied to the head end of the cylinder at about pump pressure. Thus, any tendency for the load to displace the piston at a greater rate than fluid can be supplied to the head end of the cylinder results in a reduction of pilot pressure at the valve 76 and the relief valve 74 closes until sufficient fluid is supplied to the head end of the cylinder 16 to build up the pressure at the pilot valve. As a practical matter, very little displacement of the piston is required to operate the overcenter valve 72 and the lifting arms 12 can be lowered at a predetermined rate without the danger of the load causing the arms to drop too rapidly.

Although the flow rate of fluid to the fork cylinders and arm cylinders is proportioned in such a way that the forks remain approximately horizontal, the manual valve 40 controlling the position of the forks can be operated at any time to swing the forks relative to the lifting arms 12. Displacement of the valve 40 toward the right as viewed in FIG. 4 directs fluid under pressure from the pump 54 through the check valve 73, 73′ and through the conduit 69 directly to the rod end of the fork cylinders 32. The valve 40 also connects the head end of the cylinders 32 through the conduit 65 with the reservoir 52. This causes the piston rods 34 to move inwardly and the forks 24 to swing upwardly. Conversely, shifting the spool of the valve 40 toward the left as viewed in FIG. 4, causes fluid to flow through the conduit 65 to the head end of the fork cylinders and causes fluid to flow from the rod end of the fork cylinders through the conduit 69 to the reservoir 52. A change in position of the forks by means of the manual valve 40 does not affect the proportioning that occurs at the devices 58 and 59.

The operation of the arms and forks in accordance with the hydraulic circuit of FIG. 4 is shown schematically in FIG. 3. The arms 12 are initially lowered to the position shown in solid lines in FIG. 3 with the forks positioned approximately horizontal for engagement with the sleeves 38 on the container 36. The valves 40, 44 and 48 are initially in the position shown in FIG. 4, so that the arms 12, the forks 24 and the packer head 10 are held stationary. To lift the container 36, the spool of the valve 44 controlling the arms is then displaced toward the right as viewed in FIG. 4 and fluid from the pump 54 is conducted through the device 58 and through the conduit 71 to the rod end of the arm cylinder 16. A portion of the fluid is also directed from the pump 54 through the conduit 65 to the head end of the fork cylinders 32. As the piston rods 20 are drawn into the cylinders 16, the arms 12 swing upwardly. Concurrently with the movement of the arms 12, the forks 24 swing downwardly as the arms move toward the position indicated by the letter B in FIGS. 1 and 3. Intermediate positions of the forks are shown in dotted lines. When the arms 12 are at position B, the piston in the fork cylinders has reached its outermost extent of travel. As shown in FIG. 3, the included angle between the lower end of the arm 12 and the fork 24 progressively increases as the lifting arms are raised.

From the position of the lifting arm 12 marked B to the position marked A, swinging movement of the arms 12 is at a sightly greater rate, since all of the fluid from the pump 54 is conducted directly to the rod end of the arm cylinder 16. There is flow of fluid through the device 59, the fluid being drawn from the reservoir 52 through the check valve 70 to avoid cavitation in the device 59. Fluid discharged from the head end of the arm cylinder 16 is conducted directly to the reservoir 52 through the valve 44. When the lifting arms 12 have reached the position marked A in FIGS. 1 and 3, the spool of the valve 44 is manually returned to the central position to hold the arms stationary, while the spool of the fork valve 40 is displaced toward the right as viewed in FIG. 4 to direct fluid under pressure to the rod end of the fork cylinders 32 thereby swinging the forks toward the opening 8 in the top of the body 6 and inverting the container 36, so that the contents of the container fall through the open top of the container into the interior of the body 6.

After emptying the container, the fork valve 40 is returned to the center position and the arm valve 44 is displaced toward the left as viewed in FIG. 4 to conduct fluid through the conduit 75 to the head end of the arm cylinders 66. Fluid flowing out of the rod end of the arm cylinders flow through the conduit 77 and through the overcenter valve 72 before reaching the reservoir 52. The outward movement of the pistons in the arm cylinders causes the arms to swing downwardly to the position shown in full lines in FIG. 3 with the container resting on the ground. It is usually necessary to operate the fork valve 40 to return the container to a level position before depositing it on the ground and disconnecting the forks 24 from the container sleeves 38. The packer valve 48 may then be operated to displace the packer head 10 (FIG. 1) toward the rear of the body 6 for compressing the refuse against the rear wall of the body. Reversing the valve 48 returns the packer head to its initial position.

An important advantage of the hydraulic circuit shown in FIG. 4 is that the rate of downward movement of the forks is directly proportioned to the upward movement of the lifting arms so that the container is automatically leveled. Also, fluid discharged from the fork cylindes 32 is supplied to the arm cylinders, as the arms 12 are being raised, thereby increasing the lifting capacity of the arms, without requiring increased power from the main pump 54. This hydraulic circuit not only provides automatic coordination of the forks and lifting arms, but also provides for independent swinging movement of the forks at any time.

Figure 5:
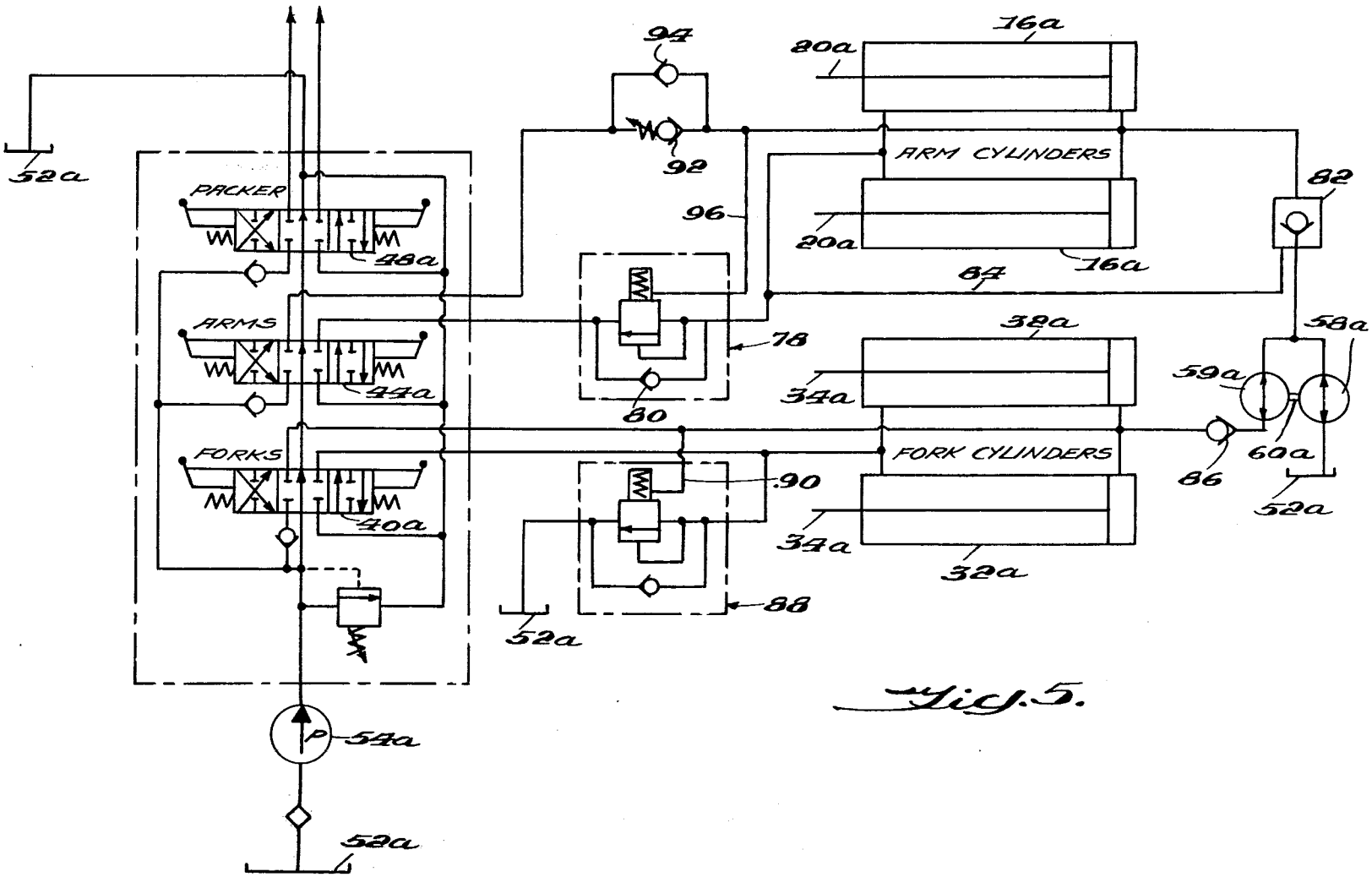
FIG. 5 is a schematic diagram of the second embodiment of the hydraulic circuit for operating the arms and forks.

The second preferred embodiment of the invention is shown schematically in FIG. 5. In this circuit, the fluid discharged from the fork cylinders during lifting of the arms does not supplement the fluid supplied by the main pump to the arm cylinders and therefore this circuit is not regenerative, as is the circuit shown in FIG. 4. Those components of this circuit which are substantially the same as the components described in the circuit of FIG. 4 are designated by the same numerals with the suffix *a*. As previously described with respect to the circuit of FIG. 4, manual control valves 40*a*, 44*a* and 48*a* are provided for the forks, arms and packer, respectfully. Displacement of the spool of the arm valve 44*a* toward the right as viewed in FIG. 5 causes fluid to be conducted through an overcenter valve 78 by means of the by-pass valve 80 to the rod end of the arm cylinders 16*a*.

Fluid discharged from the head end of the arm cyinders 16*a* is conducted to a pilot operated check valve 82. The valve 82 is maintained in an open condition in response to pressure at or slightly below the discharge pressure of the pump 54*a* being present in the conduit 84 connecting the valve 82 with the discharge conduit from the overcenter valve 78. Thus, as fluid is being conducted to the rod end of the arm cylinders, the check valve 82 remains open and fluid is conducted to a pair of pumps 58*a* and 59*a* which have their rotors ridigly connected together by a shaft 60*a*. These devices 58*a* and 59*a* function as a flow divider, since the rate of flow through the respective devices is a constant ratio. A portion of the flow from the head end of the arm cylinders 16*a* is conducted through the device 59*a* and through a check valve 86 to the head end of the fork cylinders 32*a*. This causes the pistons of the fork cylinders to be displacced toward the left as viewed in FIG. 5, thereby lowering the forks.

Fluid discharged from the rod end of the fork cylinders passes through an overcenter valve 88, which is opened in response to pilot pressure conducted through a tap 90 communicating with the head end of the fork cylinders. By this arrangement, the load on the forks 24 cannot displace the piston in the fork cylinders unless fluid is being supplied to the head end of the fork cylinders at a sufficiently high pressure to maintain the valve 88 open. When the pistons of the fork cylinders reach their outermost position, fluid pressure builds up in the head end of the arm cylinders until the spring biased relief valve 92 opens to discharge fluid through the arm valve 44*a* to the reservoir 52*a*. The relative capacities of the devices 58*a* and 59*a* are selected to provide the appropriate rate of swinging movement of the forks and the lifting arms, so that the forks remain substantially horizontal as the arms are raised toward a dumping position.

In order to lower the arms, the spool of the arm valve 44*a* is displaced toward the left as viewed in FIG. 5, so that fluid from the main pump 54*a* is supplied through the check valve 94 to the head end of the arm cylinders 16*a*, thereby displacing the pistons toward the left as viewed in FIG. 5. Fluid discharged from the rod end of the arm cylinders 16*a* is conducted through the overcenter valve 78 as long as fluid pressure in the tap 96 is slightly below the discharge pressure of the pump 54*a*. Thus, the arms are under positive control at all times during lowering of the arms. The pilot pressure in the conduit 84 is selected such that the valve 82 remains closed while fluid is flowing outwardly through the overcenter valve 78 toward the reservoir 52*a*.

In operation, the controls 40*a*, 44*a* and 48*a* are initially in the central position, as shown in FIG. 5. When the spool of the valve 44*a* is displaced toward the right, as viewed in FIG. 5, the arms are raised by fluid flowing to the rod end of the arm cylinders. As the arms move from the position shown in full lines in FIG. 3 to position B, the forks swing progressively downwardly to maintain the forks substantially level. After the fork pistons are fully extended, the arms continue to swing from position B to position A. The arms are returned to a lowered position by displacing the spool of the valve toward the left as viewed in FIG. 5. As in the circuit of FIG. 4, the forks can be raised and lowered manually by the valve 40*a* at any time.

The circuit illustrated in FIG. 5 provides automatic leveling of the forks during raising of the lifting arms, and yet has approximately the same lifting capacity as conventional systems in which the arm cylinders are controlled independently of the fork cylinders by means of the manual valves.

Figure 6:
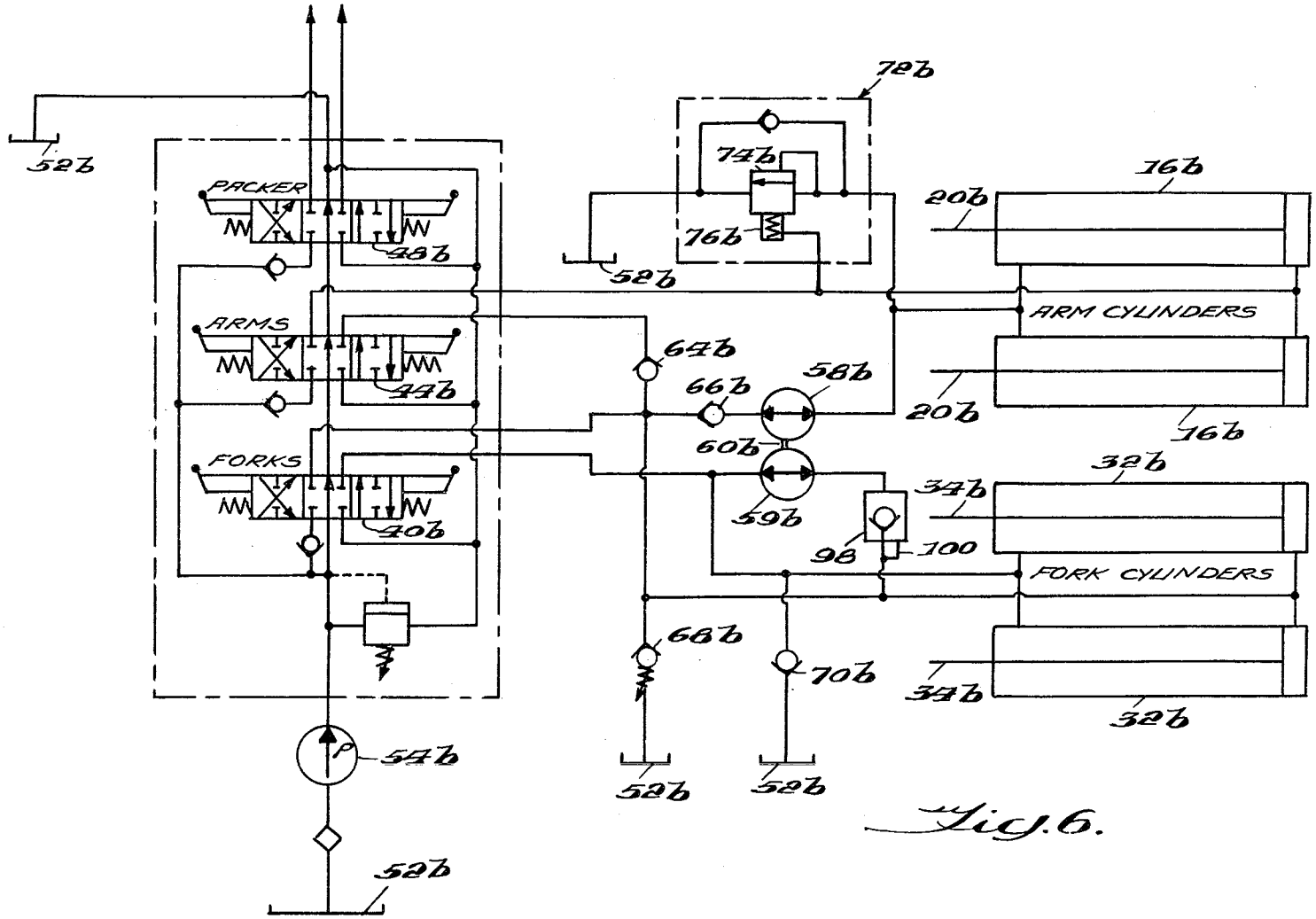
FIG. 6 is a schematic diagram of the third embodiment of the hydaulic circuit.

A third embodiment of the invention is illustrated in FIG. 6. In the schematic diagram, the components which are the same as those described and shown in FIG. 4 are designated by the same number with the suffix *b*.

When the valve 44*b* is displaced toward the right as viewed in FIG. 6 fluid under pressure is conducted from the pump 54*b*, through the check valves 64*b* and 66*b* to the device 58*b*. Fluid from the main pump 54*b* is also conducted to the head end of the fork cylinders 32*b*. Fluid discharged from the rod end of the fork cylinders is conducted to the device 59*b*. From the device 59*b*, fluid passes through a pilot operated check valve 98 in which pressure from the head end of the fork cylinders is applied through a tap 100 to maintain the valve 98 open as long as fluid at a pressure slightly less than the discharge pressure of the main pump 54*b* is being supplied to the head end of the fork cylinders.

Due to the differential area across the piston in each fork cylinder, the pressure of fluid discharged from the rod end is greater than that at the head end of fork cylinders. Fluid from the valve 98 supplements fluid from the main pump 54*b* to cause displacement of the fork pistons at a faster rate than can be provided by the pump 54*b*. Also, as fluid passes through the device 59*b*, the fluid pressure differential provides energy for turning the rotor and produces torque which is transmitted by the shaft 60*b* to drive the rotor of the device 58*b*. In this way, the pressure of the fluid flowing to the arm cylinders downstream from the device 58*b* is increased. In comparison with the circuit of FIG. 4, the circuit of FIG. 6 produces a faster angular displacement of the forks relative to upward swinging movement of the arms because fluid from the rod end of the fork cylinders is supplied to the head end of the fork cylinders. The increase in pressure produced by the motor action of the device 59*b* on the device 58*b* is greater than in the circuit of FIG. 4 because the pressure downstream from the device 59*b* is less in the FIG. 6 circuit than it is in the FIG. 4 circuit.

The arms 12 are raised by moving the spool of the valve 44*b* toward the right, as viewed in FIG. 6, causing concurrent upward swinging movement of the forks 24 and the arms 12, and after the forks 24 are fully lowered, the arms continue to move toward the dumping position. Lowering of the arms is accomplished by displacing the valve 44*b* toward the left, as viewed in FIG. 6, thereby directing fluid under pressure to the head end of the arm cylinder 16*b* and discharging fluid from the rod end of the arm cylinders through the overcenter valve 72*b* in the same manner as described with respect to the diagram of FIG. 4.

Figures 7, 8:
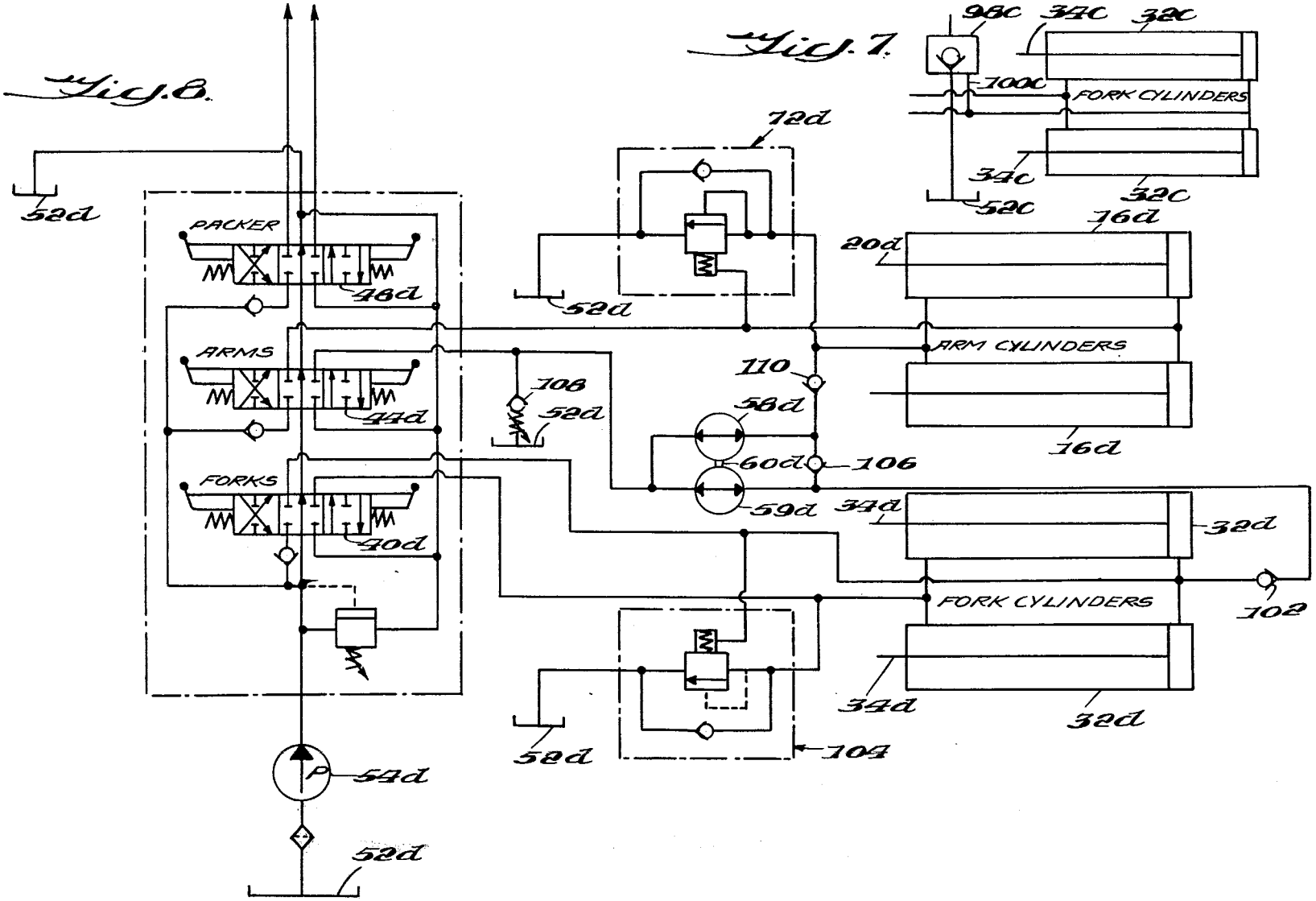
FIG. 7 is a schematic diagram of a modification of the third embodiment of the hydraulic circuit.
FIG. 8 is a schematic diagram of the fourth embodiment of the hydraulic circuit.

A modified form of the embodiment of FIG. 6 is shown in FIG. 7. The pilot operated check valve 98 of FIG. 6 is replaced by a pilot operated check valve 98*c* in which the pilot pressure is supplied through a tap 100*c* connected with the head end of the fork cylinders. The discharge side of the check valve 98*c* is connected directly with the reservoir 52*c*. In comparison with the circuit of FIG. 6, the modified circuit of FIG. 7 produces a larger pressure differential across the device 59*b*, thereby providing greater torque for driving the device 58*b*. Consequently, the modified form of FIG. 7 produces a greater boost or regenerative effect than the circuit of FIG. 6.

A fourth embodiment of the invention is shown schemtically in FIG. 8 and includes components that are the same as those of FIG. 4. These components are designated by the same reference numeral as in FIG. 4, but with a suffix letter *d*. When the valve 44*d* is displaced toward the right as viewed in FIG. 8, fluid from the pump 54*d* is directed to the rod end of the arm cylinders 16*d* through the device 58*d*. Fluid is also connected through the device 59*d* and through the check valve 102 to the head end of the fork cylinders 32*d*. The positive connection between the devices 58*d* and 59*d* by the shaft 60*d* proportions the rate of flow of fluid to the arm cylinders and fork cylinders to cause the forks to remain approximately horizontal while the arms are being raised.

As fluid flows to the head end of the fork cylinders, sufficient pressure is applied to an overcenter valve 104 to allow fluid to flow from the rod end of the fork cylinders through the valve 104 to the reservoir 52*d*. While the pistons in the arm cylinders are moving toward the right, as viewed in FIG. 8, the fluid discharged from the head end of the cylinders is conducted through the valve 44*d* to the reservoir 52*d*. After the fork cylinder pistons have been displaced to the maximum extent, the flow from the device 59*d* passes through a crossover check valve 106 and combines with fluid from the device 58*d* which is being supplied to the arm cylinders 16*d*. As long as the fork cylinders are not fully extended, the pressure required to operate the overcenter valve 104 is considerably less than the pressure at the rod end of the arm cylinders. Therefore, the flow to the head end of the fork cylinders transfers most of its energy to the device 58*d* in passing through the device 59*d*. At the same time, the fluid pressure at the rod end of the arm cylinders is greater than the pressure at the head end of the fork cylinders and this pressure differential maintains the check valve 106 closed until the fork cylinders have been fully extended. A relief valve 108 is connected upstream from the devices 58*d* and 59*d* to direct fluid to the reservoir 52*d*, to prevent pressure from becoming excessively high due to overload on the arms.

The arm cylinders may be lowered by displacing the valve 44*d* toward the left as viewed in FIG. 8, thereby directing fluid under pressure to the head end of the arm cylinders 16*d*. Fluid discharged from the rod end of the arm cylinders is conducted through the overcenter valve 72*d* to the reservoir 52*d*. A check valve 110 prevents flow from the rod end of the arm cylinders toward the pump 58*d*.

Valve 40*d* may be operated at any time during the lifting or lowering of the arms to swing the forks independently of the arms. The check valve 102 prevents fluid from flowing from the valve 40*d* to the arm cylinders 16*d*.

In each of the embodiments of this invention, the fluid which actuates the arm cylinders is also directed to the fork cylinders in a predetermined proportion to extend the piston rods of the fork cylinders at a predetermined rate relative to the rate of lifting movement of the arms. The various components of the system of this invention may be readily substituted in existing hoist units without changing the manual control valves or the arm and fork cylinders in order to convert the existing systems from manual operation to automatic operation. Furthermore, this invention permits manual override by means of the control valves at any position of the arms or the forks. Thus, the operator is in full control of the equipment at all times.

While this invention has been illustrated and described in several embodiments, it is recognized that variations and changes may be made therein without departing from the invention as set forth in the claims.

What is claimed is:

1. A hydraulic system for controlling the related operation of at least a first and second fluid actuated motor, comprising:

a pressure fluid supply, a reservoir, and control valve means communicating with the fluid supply, reservoir and first motor;

fluid transfer means operatively connected to said control valve means and the second motor to accommodate fluid flow therebetween;

a first control element in said control valve means shiftable to a transfer position directing pressure fluid to the first motor to actuate same and directing fluid displaced from the first motor to said transfer means; and flow divider means interposed in said fluid transfer means for directing a predetermined portion of said displaced fluid to the second motor to actuate the same in correlation with actuation of the first motor.

2. The hydraulic system of claim 1 further comprising check valve means located in said fluid transfer means intermediate said flow divider means and the second motor adapted to prevent reverse flow through said transfer means from the second motor to said control valve means.

3. The hydraulic system of claim 1 further comprising second control valve means communicating with the pressure fluid supply, the reservoir and the second motor, said second valve means having an associated second control element shiftable to direct fluid from the pressure fluid supply to the second motor to actuate the same and to override actuation of the second motor by said predetermined portion of displaced fluid.

4. The hydraulic system of claim 1 wherein said flow divider means communicates with the reservoir through a discharge duct, and directs the remainder of said displaced fluid to said discharge duct and reservoir.

* * * * *